US006045427A

United States Patent [19]

Yamada et al.

[11] Patent Number: 6,045,427

[45] Date of Patent: Apr. 4, 2000

[54] X-RAY IMAGE INTENSIFIER AND MANUFACTURING METHOD OF THE SAME

[75] Inventors: Hitoshi Yamada; Tadashi Shimizu, both of Otawara, Japan

[73] Assignee: Kabushiki Kaisha Toshiba, Kawasaki, Japan

[21] Appl. No.: 08/947,506

[22] Filed: Oct. 10, 1997

Related U.S. Application Data

[62] Division of application No. 08/561,861, Nov. 22, 1995, Pat. No. 5,705,885.

[30] Foreign Application Priority Data

Nov. 25, 1994 [JP] Japan ..... 6-291190
Apr. 26, 1995 [JP] Japan ..... 7-102204

[51] Int. Cl.[7] ..... H01J 43/28; H01J 9/26

[52] U.S. Cl. ..... 445/43; 228/215

[58] Field of Search ..... 445/28, 43; 228/215, 228/216

[56] References Cited

U.S. PATENT DOCUMENTS

| | | | |
|---|---|---|---|
| 3,750,266 | 8/1973 | Hikido et al. | 228/215 |
| 3,904,065 | 9/1975 | Shrader | 313/524 |
| 4,331,898 | 5/1982 | Shimizu et al. | 313/59 |
| 4,541,282 | 9/1985 | Auerweck et al. | 228/215 X |
| 4,717,860 | 1/1988 | Christgau | 313/525 |
| 4,721,884 | 1/1988 | Colomb et al. | 313/525 |
| 4,870,473 | 9/1989 | Sugimori | 250/213 |
| 4,961,026 | 10/1990 | Funk et al. | 313/525 |
| 5,506,403 | 4/1996 | Yamada et al. | 313/524 |

FOREIGN PATENT DOCUMENTS

| | | |
|---|---|---|
| 0 540 391 | 5/1993 | European Pat. Off. . |
| 56-45556 | 4/1981 | Japan . |
| 56-49053 | 5/1981 | Japan . |
| 58-36817 | 8/1983 | Japan . |
| 61-253166 | 11/1986 | Japan . |
| 63-86230 | 4/1988 | Japan . |
| 2-25704 | 1/1990 | Japan . |

OTHER PUBLICATIONS

Patent Abstracts of Japan, vol. 011, No. 105 (M–577), Apr. 3, 1987 & JP 61 253166A (Sumitomo Light Metal Ind Ltd), Nov. 11, 1986.

*Primary Examiner*—Kenneth J. Ramsey
*Attorney, Agent, or Firm*—Cushman Darby Cushman IP Group of Pillsbury Madison & Sutro LLP

[57] ABSTRACT

In an X-ray image intensifier, an incident window on which X-rays are incident is fixed to a support frame fixed to a glass vessel. The incident window has a dome portion and a flat portion around the dome portion, and is fixed to the support frame through an annular brazing sheet. The brazing sheet has brazing material layers. The brazing material layers are melted, thereby welding the brazing sheet, the incident window, and the support frame with each other. A groove is formed in the brazing sheet to form a brazing material puddle, so the brazing material will not reach the input screen of the incident window during melting.

4 Claims, 7 Drawing Sheets

X-RAY IMAGE INTENSIFIER AND MANUFACTURING METHOD OF THE SAME

This is a division of application Ser. No. 08/561,861, filed Nov. 22, 1995 now U.S. Pat. No. 5,705,885.

BACKGROUND OF THE INVENTION

1. Field of the Invention

The present invention relates to an X-ray image intensifier for converting an X-ray image into a visible optical image or electrical image signal and a manufacturing method of the same and, more particularly, to an improvement in the brazing structure of an X-ray incident window of an X-ray image intensifier and an improvement in a method of brazing the X-ray incident window of an X-ray image intensifier.

2. Description of the Related Art

An X-ray image intensifier is useful for examining the internal structure of a human body or object, and is used for converting the transmission density distribution of X-rays irradiated on the human body or object, or an X-ray image, into a visible optical image or electrical image signal.

What is required in an X-ray image intensifier is to convert the contrast or resolution of an X-ray image into a visible optical image or electrical image signal faithfully and efficiently. In practice, this faithfulness is influenced by the respective constituent elements in the X-ray image intensifier. In particular, since the conversion characteristics of an X-ray input section are inferior to those of an output section, the faithfulness of the output image is largely influenced by the characteristics of the input section. In an input section which has been conventionally used practically, a thin aluminum substrate is placed inside the X-ray incident window of a vacuum vessel, and a phosphor layer and a photo-electrical cathode layer which serve as an input screen are adhered to the rear surface of the substrate. With this structure of the input section, since the total incident X-ray transmittance is low and the X-rays scatter largely, a sufficiently high contract and resolution are difficult to obtain.

A structure in which an input screen consisting of a phosphor layer and a photo-electrical cathode layer is directly formed on the rear surface of an X-ray incident window serving as part of a vacuum vessel is described in, e.g., Jpn. Pat. Appln. KOKAI Publication No. 56-45556 and European Pat. Appln. KOKAI Publication No. 540391A1, and is thus conventionally known. In this structure, since the X-rays are transmitted through only the X-ray incident window of the vacuum vessel, a decrease in transmittance of the incident X-rays and scattering of the X-rays can be increased, so that a comparatively high contrast and resolution can be obtained.

The input screen consisting of the phosphor layer and the photo-electrical cathode layer is formed to have an optimum curved surface to minimize a distortion in image on the output screen caused by an electron lens system. For this purpose, the input screen is often formed to have a parabolic surface or a hyperboloid in place of a surface having a single radius of curvature.

Although the structure in which an input screen consisting of a phosphor layer and a photo-electrical cathode layer is directly formed on the rear surface of the X-ray incident window of a vacuum vessel is already widely known as a technique, it has not reached a sufficiently practical level yet. The major reason for this is that since the X-ray incident window of the vacuum vessel is deformed by an atmospheric pressure, the input screen is not stably adhered to the rear surface of the X-ray incident window, and an image distortion can be easily caused by an electron lens system. In an ordinary X-ray image intensifier, even if an electron lens system including an input screen is designed to have an optimum size and shape, if the input screen is deformed to be partially moved to the vacuum or outer air side by as small as, e.g., 0.5 mm, a satisfactory output image cannot be obtained due to a distortion in the electron lens system.

An input screen, in particular a phosphor layer excited with the X-rays, is formed by vacuum deposition to have a comparatively thick fine columnar crystal structure, so that it can obtain a high resolution and a high X-ray detection efficiency. In a method in which vacuum deposition is performed by placing an X-ray incident window in a deposition apparatus, however, the crystal structure of the obtained phosphor layer is largely influenced by the substrate temperature of the X-ray incident window. For example, since a phosphor layer made of cesium iodide (CsI) activated with sodium (Na) is deposited on the substrate to a thickness of about 400 $\mu$m, an increase in substrate temperature caused by heat of sublimation generated when the evaporation material attaches to the incident window substrate or radiation heat generated by the evaporation apparatus is not negligible. If a phosphor layer is to be formed to a predetermined thickness within a short period of time, the substrate temperature is increased quickly, and sufficiently thin columnar crystal grains cannot be obtained. The thinner the incident window is formed to increase the X-ray transmittance, the more conspicuous the temperature increase in window substrate becomes during film formation, and sufficiently thin columnar crystals cannot be obtained. To avoid these problems, the amount of phosphor attaching to the substrate per unit time may be decreased. Then, however, a deposition time required for forming a phosphor layer to a required thickness is prolonged very much, leading to a lack in industrial practicability.

As a technique for hermetically bonding a thin aluminum X-ray incident window to a comparatively thick iron-alloy support frame, a thermocompression bonding technique in which bonding is performed by heating and pressure has been employed in practice. However, this technique merely substantially aims at bonding an X-ray incident window as part of a vacuum vessel to the main body of the vacuum vessel, and an X-ray image intensifier in which an input screen is directly formed on the inner surface of the X-ray incident window fabricated in this manner is supposed to lack in practicability. This is because deformation of the X-ray incident window due to a high pressure applied during thermocompression bonding cannot be avoided, and a high resolution cannot be obtained accordingly.

A technique in which an iron-alloy support frame and an aluminum X-ray incident window are brazed by interposing a brazing sheet between them is disclosed in, e.g., Jpn. Pat. Appln. KOKAI Publication No. 61-253166 and Jpn. Pat. Appln. KOKOKU Publication No. 2-25704. With the brazing structure disclosed in these official gazettes, deformation of the X-ray incident window caused by bonding itself does not substantially occur. However, the bent portion where the flat portion around the X-ray incident window changes to a convex spherical surface and its inner circumferential portion close to it are not supported by a high-strength member. Thus, when this structure is completed as an X-ray image intensifier, because of the atmospheric pressure, it is found that the inner circumferential portion of the bent portion tends to be largely deformed upon application of a stress to the portion around the X-ray incident window, particularly to the bent portion. Therefore, a distortion occurs in the electron lens system, and a high resolution cannot be obtained.

In order to prevent this, a method may be possible wherein, as shown in FIG. 1, a sufficiently wide brazing sheet 23 is interposed between a flat portion 21*a* of an annular support frame 21 having a crank-shaped half-section and made of an iron alloy and a peripheral flat portion 22*a* of a convex spherical X-ray incident window 22 made of an aluminum material, and this structure is heated, thereby achieving hermetic brazing. The brazing sheet 23 consists of a core portion 23*a* made of an aluminum material and brazing material layers 23*b* and 23*c* integrally formed on the two surfaces of the core portion 23*a* as clad layers.

When brazing is performed in practice in this manner, however, the molten brazing material is fluidized to creep over from the inner surface of the flat portion 21*a* of the annular support frame 21 and a bent portion 22*b* of the X-ray incident window 22 upward to the region of the convex spherical portion 22*c*, and thereafter forms a solidified fluid brazing material layer B. In particular, fine corrugations are usually formed on the entire inner surface of the window to increase the adhesion strength of the CsI phosphor layer to the inner surface of the X-ray incident window. The molten brazing material during brazing tends to widely flow on the finely corrugated surface formed in this manner. Then, the fluid brazing material layer B creeps up to a region where an input screen 24 is to be formed, as shown in FIG. 2.

When the fluid brazing material layer B is present up to the prospective input screen forming region, even if the brazing material layer B is very thin, since the region of the aluminum substrate itself and the region of the brazing material layer B itself have different reflectances for a light beam emitted by the CsI phosphor layer, a luminance change boundary appears comparatively clearly particularly in the peripheral portion of an output image. Also, the adhesion strength of the phosphor layer is degraded.

SUMMARY OF THE INVENTION

It is an object of the present invention to provide an X-ray image intensifier which has a highly reliable hermetic bonding portion that suppresses deformation of the aluminum-material X-ray incident window of a vacuum vessel to which an input window is directly formed, thus providing a good luminance distribution and a high resolution without adversely affecting the characteristics of the input screen, and a method of manufacturing the same.

According to the present invention, there is provided an X-ray image intensifier including an X-ray incident window consisting of an aluminum material and formed in a portion on which X-rays are to be incident, the X-ray incident window constituting part of a vacuum envelope and having a central portion which forms a convex spherical shape projecting to an outer air side; a high-strength support frame to which the peripheral portion of the X-ray incident window is hermetically sealed by a brazing sheet having a brazing material layer; an input screen, stacked on a surface of a predetermined region of the X-ray incident window on a vacuum space side, excluding the peripheral portion of the X-ray incident window, for converting an X-ray image into a photoelectron image; a plurality of electrodes for constituting an electron lens system that accelerates and focuses photoelectrons; and an output screen for converting the photoelectron image into either an optical image or an electrical image signal, comprising means for prohibiting a brazing material that hermetically brazes the brazing sheet with the peripheral portion of the X-ray incident window from reaching a region where the input screen is to be formed.

According to the present invention, there is also provided an X-ray image intensifier provided with means for mechanically holding a convex spherical portion of the X-ray incident window, which is close to the flat portion, from the vacuum space side.

Furthermore, according to the present invention, there is provided an X-ray image intensifier manufacturing method of hermetically brazing a peripheral portion of a convex spherical X-ray incident window consisting of an aluminum material and forming part of a vacuum envelope to a high-strength support frame, forming an input screen for converting an X-ray image into a photoelectron image on the inner surface of the X-ray incident window, hermetically brazing the X-ray incident window to the trunk portion of the vacuum envelope, and evacuating the interior of the vacuum envelope, comprising: interposing a brazing sheet having a brazing material layer between the X-ray incident window and the high-strength support frame; and providing means for preventing the molten brazing material from reaching the input screen forming region during brazing, thereby performing hermetic brazing.

With the present invention, an X-ray image intensifier can be obtained that can have a highly reliable hermetic brazing portion while suppressing deformation of the X-ray incident window of a vacuum envelope consisting of the aluminum material to which an input window is directly formed, and that has a good luminance distribution and a high resolution, without adversely affecting the characteristics of the input screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An X-ray image intensifier and the manufacturing method of the same according to the present invention will be described with reference to the accompanying drawings.

Figure 3A:
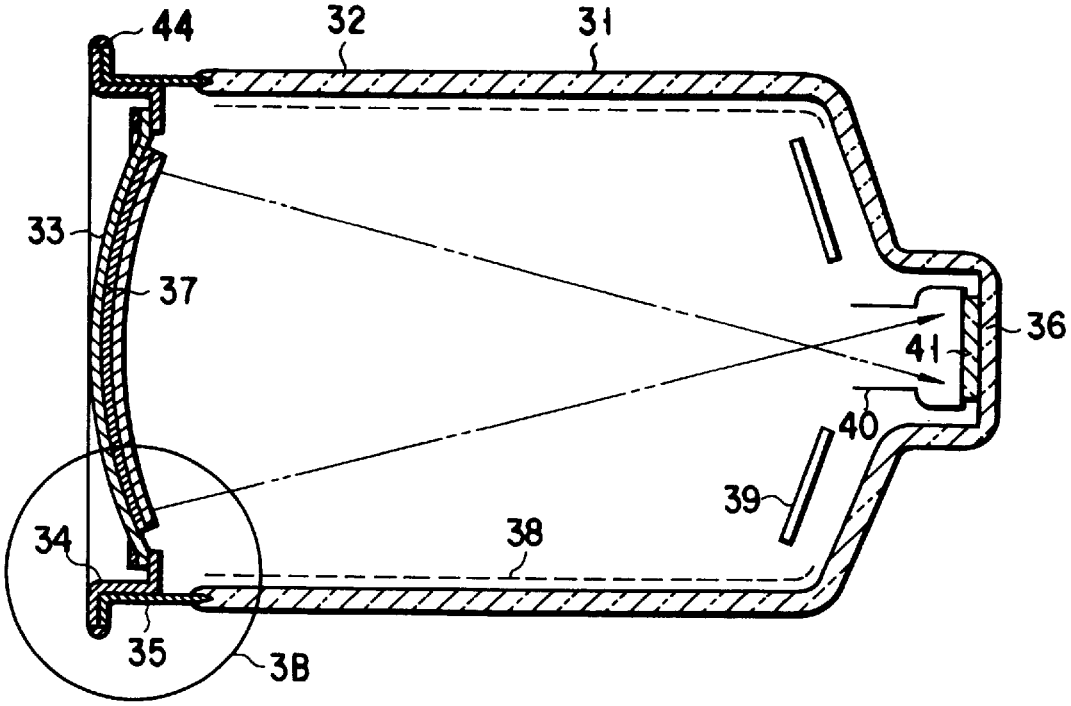
FIG. 3A is a sectional view schematically showing an X-ray image intensifier according to an embodiment of the present invention.
Figure 3B:
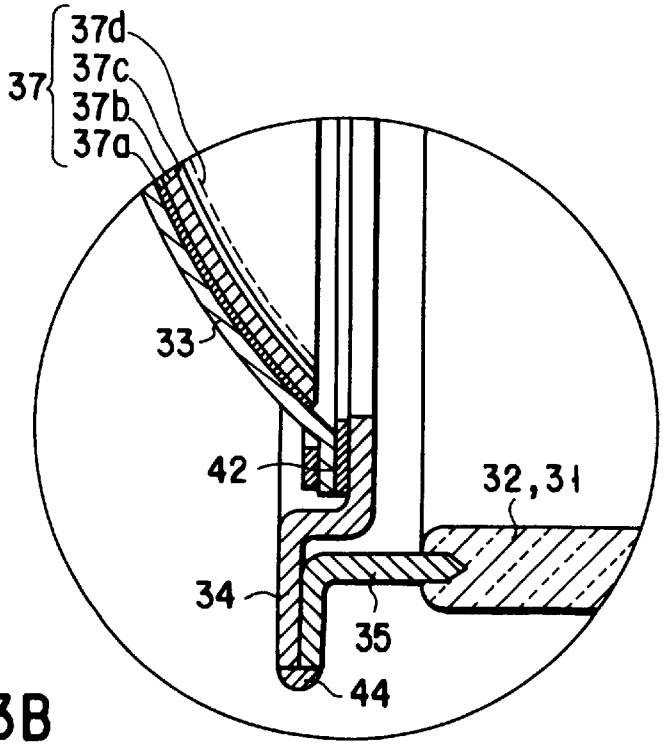
FIG. 3B is an enlarged longitudinal sectional view showing a portion denoted by reference numeral 3B in FIG. 3A.

An embodiment in which the present invention is applied to an X-ray image intensifier having an input screen with an effective maximum diameter of about 230 mm will be described with reference to FIGS. 3A and 3B. As shown in FIG. 3A, a vacuum envelope 31 has a cylindrical trunk portion or vessel 32 made of glass, an X-ray incident window 33 formed in the trunk portion 32 on the X-ray incident side, a high-strength support frame 34 and a sealing metal ring 35 that hermetically sealed the X-ray incident window 33 to the trunk portion 32, and an output window 36 made of transparent glass. The dome-shaped X-ray incident window 33 as part of the vacuum envelope 31 is formed into a curved surface such that its central portion projects to the outer air side, and an input screen 37 is directly formed on the inner surface of the X-ray incident window 33 on the vacuum space side. A plurality of focusing electrodes 38 and 39 for forming an electron lens system that focuses an electron beam, and a cylindrical anode 40 to which a high accelerating voltage for accelerating the electron beam is applied are arranged inside the vacuum vessel 31. Furthermore, an output screen 41 having a phosphor layer excited with incident electrons is arranged close to the anode 40 of the output window 36.

Figure 1:
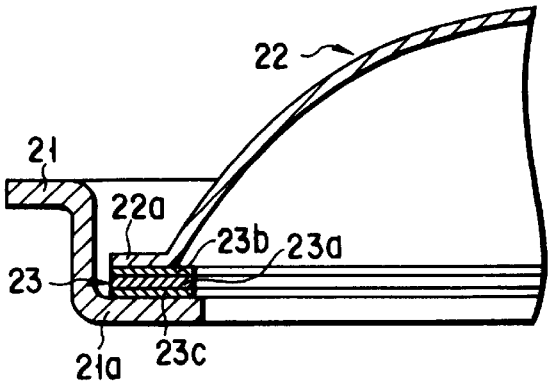
FIG. 1 (PRIOR ART)
FIG. 1 is a half-sectional view showing the main part of the X-ray incident window of a conventional X-ray image intensifier before it is brazed to a vacuum vessel.
Figure 2:
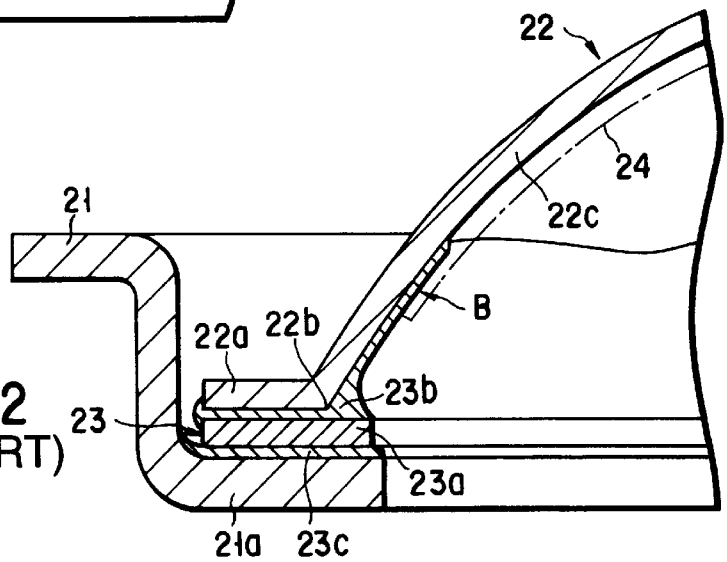
FIG. 2 (PRIOR ART)
FIG. 2 is an enlarged sectional view showing the main part of the structure of FIG. 1 after brazing.
Figure 4:
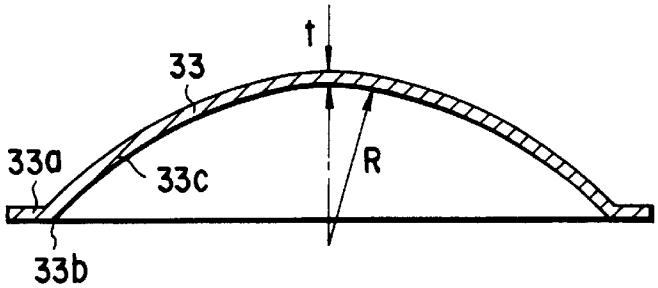
FIG. 4 is a longitudinal sectional view showing the shape of an X-ray incident window shown in FIG. 3B.

The X-ray incident window 33 is formed from a thin plate made of an aluminum material, e.g., pure aluminum or an aluminum alloy. More specifically, as shown in FIG. 4, the X-ray incident window 33 is obtained by pressing the aluminum thin plate such that its central portion projects to the outer air side to have an inner surface of the X-ray incident window 33, the inner surface having a distribution of a predetermined radius R of curvature and the X-ray incident window 33 having a distribution of a predetermined thickness t. The X-ray incident window 33 also has a peripheral flat portion 33*a* extending in the lateral direction. In FIG. 4, reference symbol 33*b* denotes a bent portion; and 33*c*, a convex spherical portion.

Figure 5:
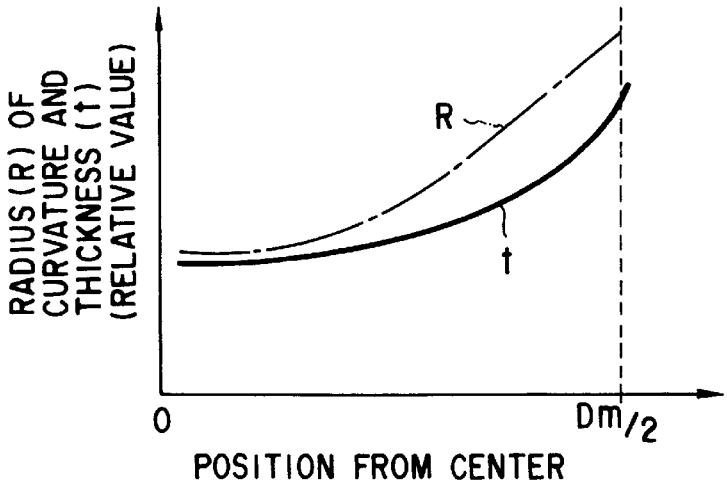
FIG. 5 is a graph showing the distributions of the radius of curvature and thickness of the X-ray incident window shown in FIG. 4.

FIG. 5 shows the distribution of the radius R of curvature of the inner surface and the distribution of the thickness t of the convex spherical portion 33*c* of the fabricated X-ray incident window 33 consisting of the aluminum material. More specifically, the X-ray incident window 33 has a distribution in which its radius R of curvature and thickness t gradually increase from its central axis O toward the peripheral edge of the input screen 37 to a diameter Dm. The radius R of curvature of the X-ray incident window 33 is about 135 mm at the central portion, 193 mm at the intermediate portion in the radial direction, and about 338 mm in the peripheral portion, and the thickness t of the X-ray incident window 33 is 0.8 mm at the central portion, about 0.9 mm at the intermediate portion, and about 1.1 mm at the peripheral portion. When the X-ray incident window 33 is formed to have these distributions in radius of curvature and thickness, the amount of deformation of the incident window caused by the atmospheric pressure is decreased, and an undesirable distortion in the input screen and the electron lens system constituted by the focusing electrodes can be prevented.

The entire inner surface of the X-ray incident window 33 consisting of the aluminum material is subjected to honing, thereby forming fine corrugations having an average height of about several $\mu$m, and the material of the X-ray incident window 33 is set.

Figure 6:
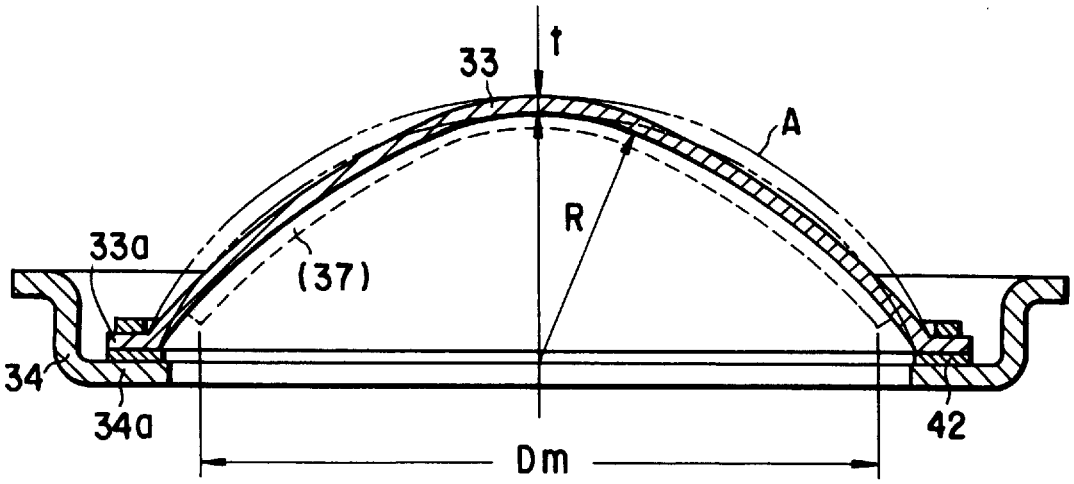
FIG. 6 is a partially longitudinal sectional view showing the brazed state of the embodiment of the present invention.

Subsequently, as shown in FIG. 6, the flat portion 33*a* of the X-ray incident window 33 is placed on a flat portion 34*a* of the high-strength metal support frame 34 made of an iron alloy, e.g., stainless steel. The support frame 34 is sufficiently thicker than the X-ray incident window 33, and has a nickel plating layer on its entire surface. A brazing sheet 42 is interposed between the flat portion 33*a* and the portion 34*a*, and the entire structure is heated to about 600° C. in vacuum, thereby hermetically brazing the flat portion 33*a* and the portion 34*a*. In FIG. 6, a chain double-dashed line A indicates a single-curvature spherical surface which is drawn for the convenience of comparison in order to help understanding the change in curvature of the spherical portion 33*c* of the X-ray incident window 33, and a dotted line 37 indicates an input screen formed on the X-ray incident window 33 after the X-ray incident window 33 is brazed.

The high-strength support frame 34 and the X-ray incident window 33 that are brazed in this manner are provided as part of the wall of the reduced-pressure chamber of a film forming apparatus (not shown) without cleaning or the like, and the input screen 37 is formed on the inner surface of the X-ray incident window 33 while externally directly controlling the temperature of the X-ray incident window 33. More specifically, when the interior of the reduced-pressure chamber having the X-ray incident window 33 as its part is set in a predetermined vacuum degree, a thin film of a material that reflects the light beam, e.g., an aluminum thin film 37*a*, is formed on the inner surface of the incident window to a thickness of 2,000 Å, as shown in FIG. 3B. Subsequently, a phosphor layer 37*b* that generates a light beam upon being excited with the X-rays is formed on the aluminum thin film 37*a* by controlling the temperature distribution of the X-ray incident window 33 with a temperature controller (not shown) arranged on the outer air side of the X-ray incident window 33. The phosphor layer 37*b* is formed of cesium iodide (CsI) activated with sodium (Na), to a thickness of about 400 μm at a pressure of $4.5\times10^{-1}$ Pa by vacuum deposition, and then to a thickness of about 20 μm at a pressure of $4.5\times10^{-3}$ Pa by vacuum deposition. A transparent conductive film 37*c* is formed on the phosphor layer 37*b*.

Figure 7:
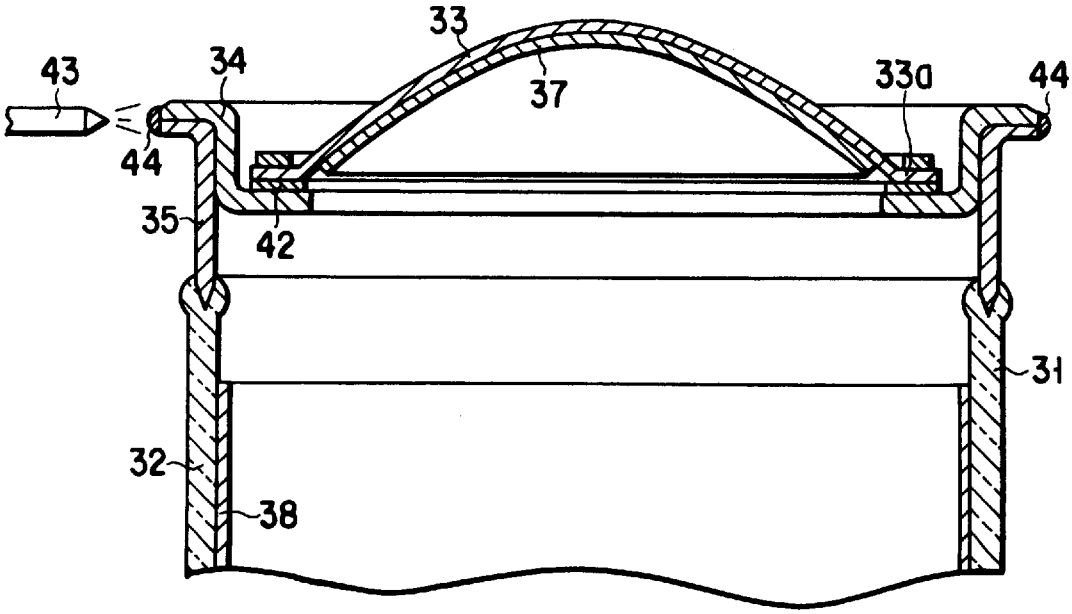
FIG. 7 is a longitudinal sectional view showing the bonding process of the X-ray incident window of the X-ray image intensifier of the present invention to a vacuum vessel.

As shown in FIG. 7, the support frame 34 integrally sealed to the X-ray incident window 33 forming part of the input screen 37 is mated with the sealing metal ring 35 which is made of an iron-nickel-cobalt alloy and which is sealed in advance to the distal end of the glass trunk portion 32 forming part of the vacuum envelope. The support frame 34 and the sealing metal ring 35 are hermetically welded to each other throughout their entire circumferences with a torch 43 of a Heliarc welding apparatus. This hermetically welded portion is denoted by reference numeral 44. Thereafter, the interior of the vacuum envelope is evacuated, and the material of the photo-electrical cathode layer 37*d* that partly constitutes the input screen 37 and converts the light beam into electrons is evaporated in the vacuum envelope, thus forming the photo-electrical cathode layer 37*d*. An X-ray image intensifier is thus completed. In this manner, an X-ray image intensifier having good contrast and resolution characteristics is manufactured in which the X-ray incident window is not much deformed by the atmospheric pressure, the uniformity of the X-ray transmittance in the entire region of the incident window is not much impaired, and peeling of the input screen or distortion in the electron lens system does not occur.

Figure 8:
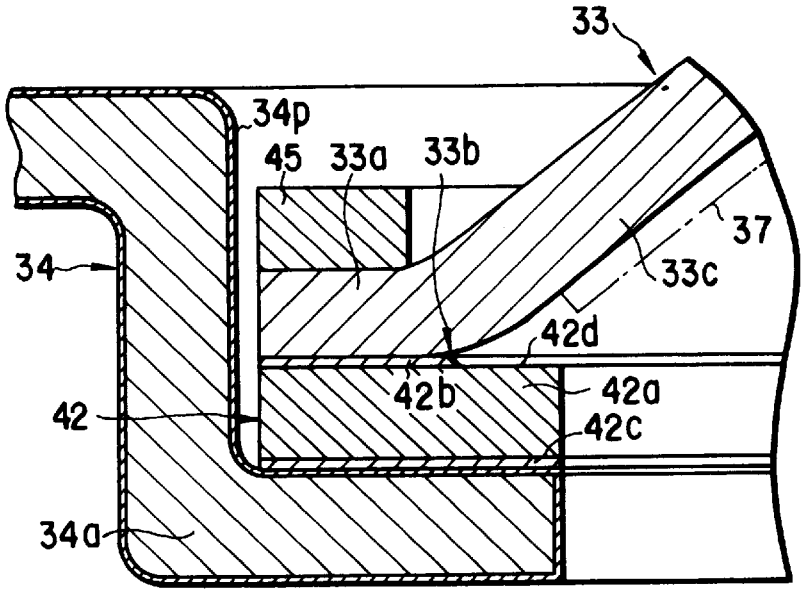
FIG. 8 is a partially enlarged sectional view showing the brazed state of the embodiment of the present invention.

The hermetic brazed portion of the X-ray incident window 33 consisting of the aluminum material and the support frame 34 will be described. As shown in FIG. 8, in the welded portion, a nickel plating layer 34*p* having a thickness of about 10 μm is plated or coated, as described above, on the entire surface of the high-strength stainless-steel support frame 34 having a thickness of about 1.5 mm and a crank-shaped half-section, and the resultant structure is heated to a temperature of about 900° in vacuum to improve the adhesion properties between the support frame 34 and the plating layer 34*p*. The brazing sheet 42 is placed on the upper surface of the flat portion 34*a* of the support frame 34. The peripheral flat portion 33*a* of the X-ray incident window 33 consisting of the aluminum material is placed on the brazing sheet 42. A stainless steel auxiliary ring 45 is placed on the flat portion 33*a*.

The brazing sheet 42 consists of an aluminum-alloy core portion 42*a* having a thickness of about 0.8 mm, and brazing layers 42*b* and 42*c* integrally formed on the two surfaces of the core portion 42*a* as clad layers and each having a thickness of about 0.1 mm. The width of the brazing sheet 42 is much larger than the width of the peripheral flat portion 33*a* of the X-ray incident window 33 in the radial direction. Hence, the brazing layer 42*b* of the brazing sheet 42 which is to be brazed to the X-ray incident window 33 is formed on only a given region which is brought into contact with the bent portion 33*b* of the X-ray incident window 33, and an inner region of the brazing sheet 42 excluding the given region is removed, so that an upper surface 42*d* of the core portion 42*a* is exposed. A chain line denoted by reference numeral 37 in FIGS. 8 and 9 indicates an input screen which is formed later on. Naturally, the input screen 37 is formed on a region of the X-ray incident window 33 inside the bent portion 33*b* of the X-ray incident window 33 or inside the inner circumferential edge of the brazing sheet 42.

Furthermore, a weight (not shown) is placed on the auxiliary ring 45, and the resultant structure is heated at a temperature of about 600° for about 20 minutes in a vacuum to melt the brazing layers of the brazing sheet, so that the X-ray incident window 33 and the high-strength support frame 34 are brazed in vacuum through the brazing sheet 42. The total weight of the auxiliary ring 45 and the weight (not shown) is set such that a small load of about 160 g/cm$^2$ is applied to the brazed portion.

Figure 9:
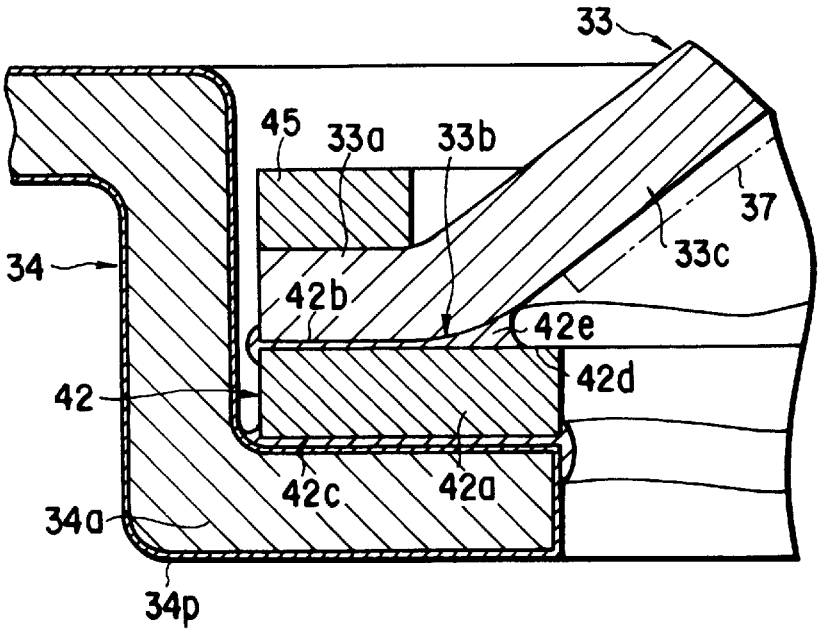
FIG. 9 is a partial enlarged sectional view showing the bonded state after brazing of FIG. 8.

A bonded state after brazing as shown in FIG. 9 is obtained by this brazing. More specifically, part of the brazing layer 42*b* of the brazing sheet 42 which is melted during brazing flows to the outer and inner sides of the brazed portion. In particular, on the inner side of the brazed portion, the brazing material slightly creeps over the exposed upper surface 42*d* of the core portion 42*a*, from which the brazing layer 42*b* has been removed in advance, and the inner side of the bent portion 33*b* of the X-ray incident window 33, to form a brazing material puddle 42*e*. This brazing material puddle 42*e* is limited within a region of as small as 5 mm at maximum from the bent portion 33*b* toward the inner inclined surface of the X-ray incident window 33, and does not reach a region where the input screen 37 will be formed. Rather, the brazing material puddle 42*e* serves to mechanically hold a portion of the X-ray incident window 33. In this manner, according to this embodiment, a highly reliable hermetic brazed portion can be obtained, the brazing material is prevented from reaching a region on the inner surface of the X-ray incident window where the input screen is to be formed, and a deformation of a portion of the X-ray incident window in the vicinity of its peripheral bent portion, which can be deformed particularly easily, is prevented. Therefore, a decrease in adhesion strength of the input screen, non-uniformity in luminance, or distortion in the electron lens system is prevented, so that an X-ray image having a high resolution can be obtained. Note that the auxiliary ring 45 prevents the weight (not shown) from undesirably adhering to the X-ray incident window. The auxiliary ring 45 itself adheres to the X-ray incident window and mechanically reinforces it.

Figure 10:
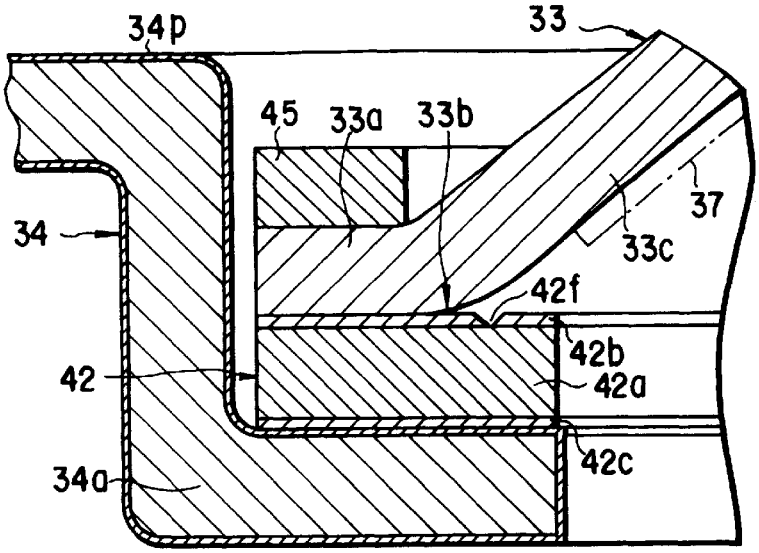
FIG. 10 is a partial enlarged sectional view showing an X-ray image intensifier according to another embodiment of the present invention before brazing.

In an embodiment shown in FIG. 10, a groove 42*f* which has a substantially V-shaped section and is obtained by partially removing a brazing layer 42*b* is formed in the upper surface of a brazing sheet 42, i.e., at a position slightly inside a bent portion 33*b* of the X-ray incident window 33.

When the V-shaped groove 42*f* is formed, the molten brazing material during brazing is prevented from excessively flowing to reach the input screen forming region on the inner surface of the incident window. Also, the convex spherical portion 33*c* in the vicinity of the bent portion 33*b* is mechanically held, at the vacuum space side, by the brazing material puddle formed in the vicinity of the bent portion 33*b* of the X-ray incident window 33.

Figure 11:
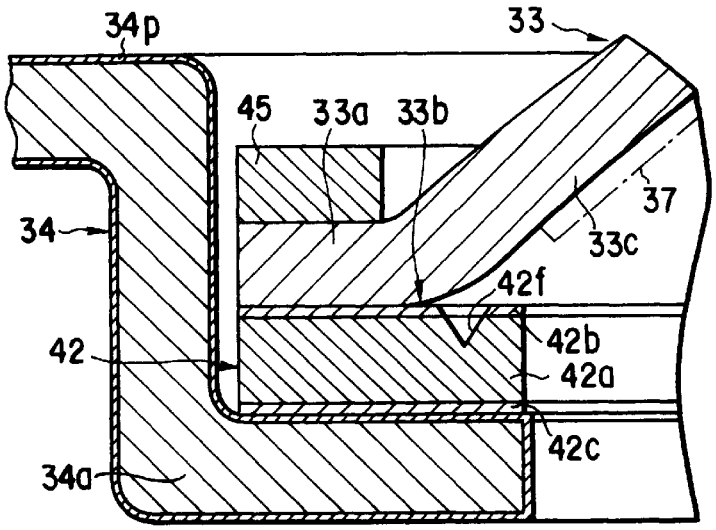
FIG. 11 is a main part enlarged sectional view showing an X-ray image intensifier according to still another embodiment of the present invention before brazing.
Figure 12:
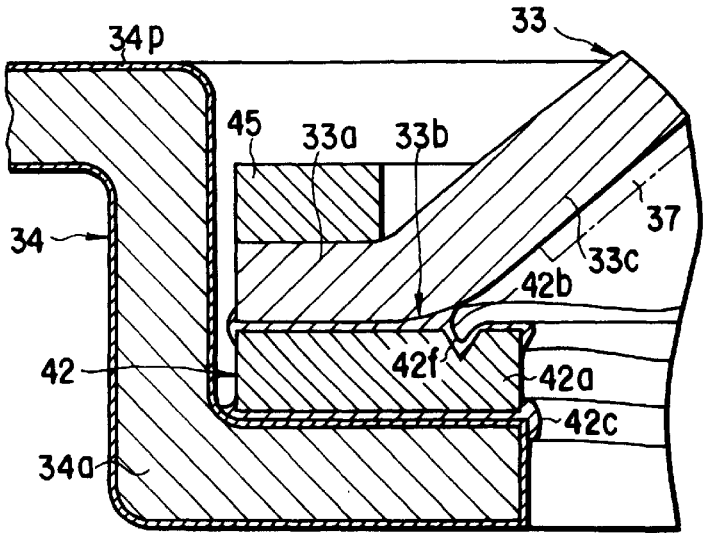
FIG. 12 is a partial enlarged sectional view showing the bonded state after brazing of FIG. 11.

In an embodiment shown in FIG. 11, a deep V-shaped groove 42*f* is formed in the upper surface of the brazing sheet 42 inside an incident window bent portion 33*b* so as to reach the intermediate portion of a brazing sheet core portion 42*a*. The brazing layer in the groove 42*f* is naturally removed. Upon brazing, most of the excessive molten brazing material in the vicinity of the incident window bent portion 33*b* is collected in the V-shaped groove 42*f*, as shown in FIG. 12. As a result, the brazing material is prevented more reliably from reaching the input screen forming region on the inner surface of the incident window.

Figure 13:
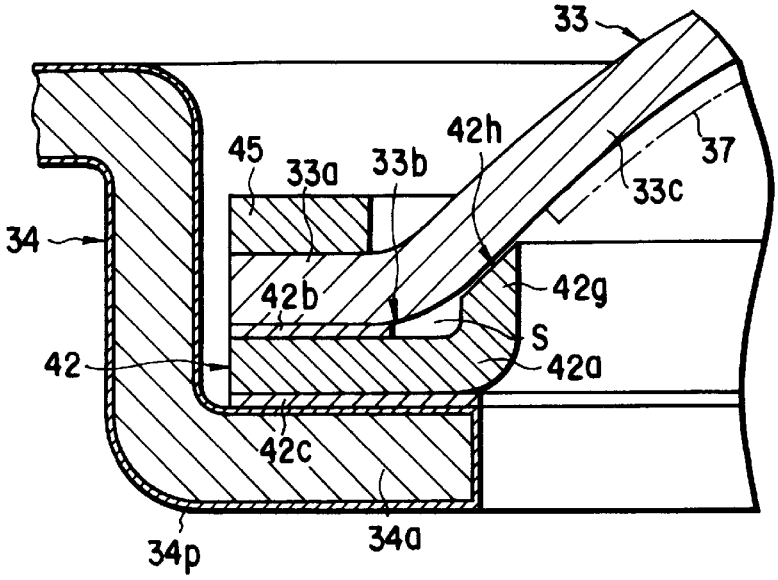
FIG. 13 is an enlarged sectional view showing the main part of an X-ray image intensifier according to still another embodiment of the present invention before brazing.

In an embodiment shown in FIG. 13, brazing layers are removed from the upper and lower inner surfaces of a brazing sheet 42 that are not in contact with either an X-ray incident window 33 or a high-strength support frame 34, and the inner circumferential edge of a core portion 42*a* of the brazing sheet 42 is bent toward a convex spherical portion 33*c* of the X-ray incident window 33, thus forming a core bent portion 42*g*. The upper end of the core bent portion 42*g* forms a tapered surface 42*h* extending along the inner surface of the convex spherical portion 33*c* of the X-ray incident window 33. A small gap corresponding to the thickness of a brazing layer 42*b* of the brazing sheet 42 is defined between the inner surface of the convex spherical portion 33*c* and the tapered surface 42*h* before brazing. When the brazing layer 42*b* is melted, the inner surface of the convex spherical portion 33*c* and the tapered surface 42*h* come close to each other and are brought into contact with each other. Thus, a space S in which the brazing layer does not exist is formed on the outer circumferential side of the core bent portion 42*g*. The core bent portion 42*g* is located outside the input screen forming region.

Figure 14:
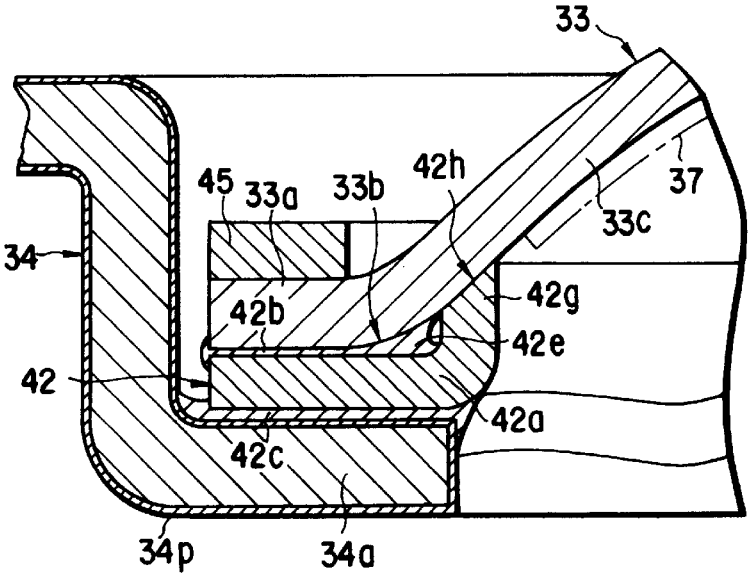
FIG. 14 is an enlarged sectional view showing the main part of the bonded state after brazing of FIG. 13.

When brazing is performed in this state, the molten brazing material is collected in the space S on the outer circumferential side of the core bent portion 42*g*, and is solidified, as shown in FIG. 14. As the thickness of a portion of the brazing layer 42*b* of the brazing sheet 42 is decreased, the tapered surface 42*h* of the core bent portion 42*g* is brought into contact with the inner surface of the convex spherical portion 33*c* of the X-ray incident window 33, and mechanically holds this inner surface at the vacuum space side. In this manner, the core bent portion 42*g* reliably prevents the brazing material from flowing to the input screen forming region, and mechanically holds the end portion of the convex spherical portion 33*c* of the X-ray incident window 33 at the vacuum space side. Therefore, a highly reliable X-ray incident window structure substantially free from deformation can be obtained.

Figure 15:
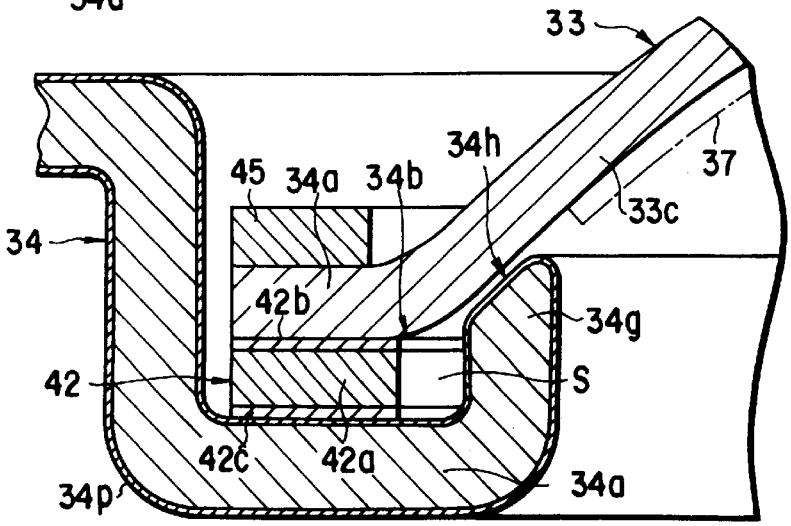
FIG. 15 is an enlarged sectional view showing the main part of an X-ray image intensifier according to still another embodiment of the present invention before brazing.
Figure 16:
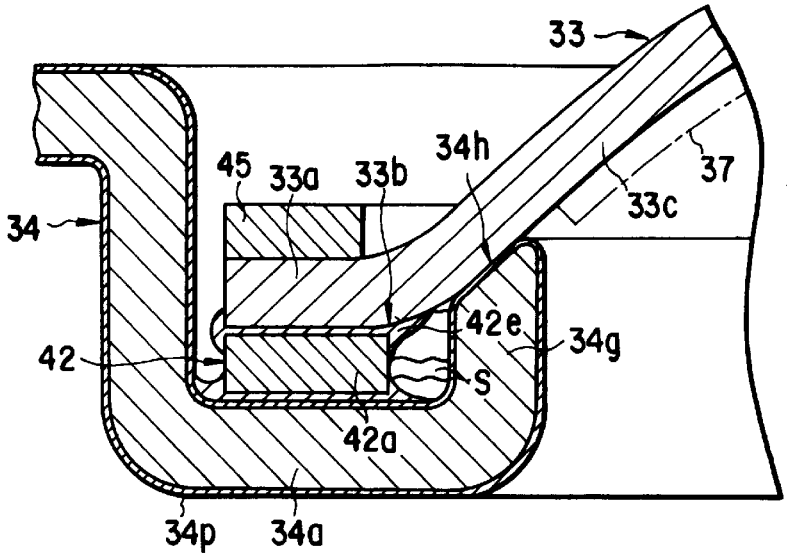
FIG. 16 is an enlarged sectional view showing the main part of the bonded state after brazing of FIG. 15.

In FIG. 15, and FIG. 16 that shows the state after brazing of FIG. 15, the inner surface portion of a high-strength support frame 34 is bent toward an X-ray incident window 33, thus forming a support frame bent portion 34*g* in the same manner as in the above embodiment. In this embodiment, a brazing sheet 42 is set to have a width corresponding to the width of a peripheral flat portion 33*a* of an X-ray incident window 33 in the radial direction, and the brazing material layer is not removed. During brazing, the brazing material which is melted and solidified is collected in a space S formed outside the support frame bent portion 34*g*, so that it is reliably prevented from flowing to the input screen forming region. In this embodiment, due to the support frame bent portion 34*g*, the mechanical strength of the support frame 34 itself and the strength with which the end portion of the convex spherical portion of the incident window is mechanically held from the vacuum space side are further increased, so that the X-ray incident window is not easily deformed.

Figure 17:
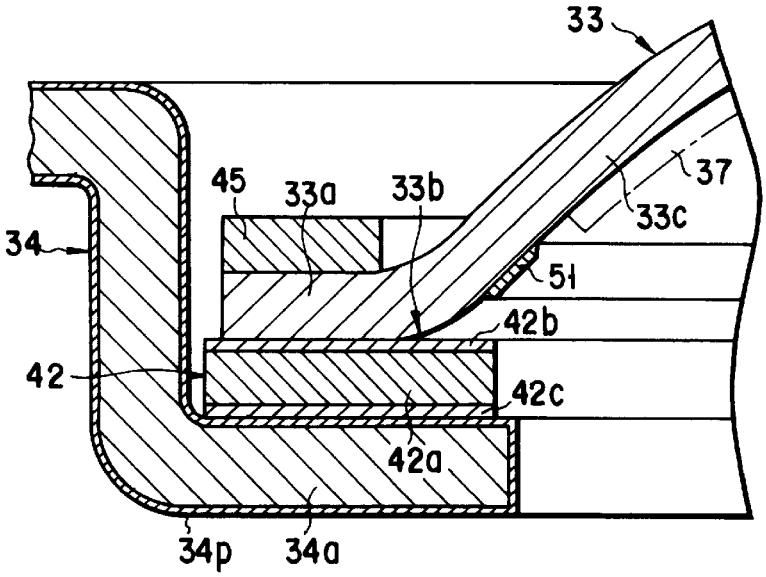
FIG. 17 is an enlarged sectional view showing the main part of an X-ray image intensifier according to still another embodiment of the present invention before brazing.
Figure 18:
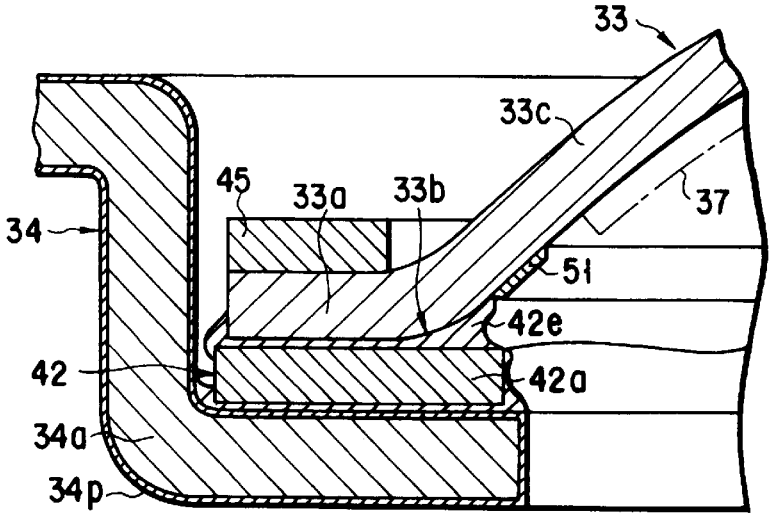
FIG. 18 is an enlarged sectional view showing the main part of the bonded state after brazing of FIG. 17.

In an embodiment shown in FIG. 17, a brazing material anti-wetting layer 51, which is made of a material that cannot be easily wetted with the molten brazing material during brazing, is adhered in advance to a region located slightly outside the input screen 37 region on the inner surface of an X-ray incident window 33. The brazing material anti-wetting layer 51 is preferably made of a material, e.g., a metal oxide, which discharges a small amount of gas in vacuum. Because of the presence of the brazing material anti-wetting layer 51, a brazing material puddle 42*e* is formed outside the brazing material anti-wetting layer 51 after brazing, so that the molten brazing material is reliably prevented from flowing to the input screen forming region. Accordingly, with this embodiment, the support frame or the brazing sheet can have a simple shape, and the brazing material layers need not be removed, facilitating the manufacture.

Regarding the materials of the respective portions, a stainless steel SUS304L of the JIS (same applies to the following description) is suitable for both a support frame 34 and an auxiliary ring 45.

As the X-ray incident window 33, an aluminum alloy A6061 is suitable. The chemical components added to aluminum to form this aluminum alloy are approximately 0.4 to 0.8% of Si, 0.7% of Fe, 0.15 to 0.4% of Cu, 0.15% of Mn, 0.8 to 1.2% of Mg, and the balance.

In using an aluminum alloy to form the X-ray incident window, the 3,000-, 5000-, or 6000-odd aluminum alloys of Japanese Industrial Standards (JIS) that have a high mechanical strength are preferable. The chemical components in these aluminum alloys are approximately as follows. More specifically, each of the 3000-odd aluminum alloys of the JIS contains 0.3 to 1.2% of Si, 0.1 to 0.4% of Cu, 0.03 to 0.8% of Mn, 0.35 to 1.5% of Mg, and the balance. Each of the 5000-odd aluminum alloys of the JIS contains 0.3 to 0.6% of Si, 0.05 to 0.3% of Cu, 0.8 to 1.5% of Mn, 0.2 to 1.3% of Mg, and the balance. Each of the 6000-odd aluminum alloys of the JIS contains 0.2 to 0.45% of Si, 0.04 to 0.2% of Cu, 0.01 to 0.5% of Mn, 0.5 to 5.6% of Mg, and the balance.

In a brazing sheet 42, an aluminum alloy A6951 is suitable as the core portion, and an aluminum alloy BA4004 is suitable as the brazing material layers to be cladded. In the aluminum alloy A6951, the chemical components added to aluminum are approximately 0.2 to 0.5% of Si, 0.8% or less of Fe, 0.15 to 0.4% of Cu, 0.1% of less of Mn, 0.4 to 0.8% of Mg, and the balance. In the aluminum alloy BA4004, the chemical components-added to aluminum are approximately 9.0 to 10.5% of Si, 0.8% or less of Fe, 0.25% or less of Cu, 0.1% or less of Mn, 1.0 to 2.0% of Mg, and the balance.

The material of the brazing material layer of the brazing sheet is not limited to those described above. For example, BA4003, BA4005, BA4N04, or the like can also be employed.

The brazing sheet described above contains Mg (magnesium). Mg promotes brazing, as it replaces the flux on the brazing surface. In the long-term use, however, Mg may contaminate the interior of the brazing vacuum furnace as well as the surface of the X-ray incident window made of the aluminum material. If brazing is promoted by increasing the pressure applied during vacuum brazing to several times that of the above embodiment, a brazing sheet which does not substantially contain Mg can be used. Then, a degradation in quality of the surface of the X-ray incident window can be prevented, thereby improving the adhesion strength and the like of the input screen.

As has been described above, according to the present invention, a highly reliable hermetic bonding portion, that can suppress deformation of the X-ray incident window consisting of the aluminum material in a vacuum vessel, to which an input window is directly formed, and can prevent creeping of the brazing material over the input screen forming region, can be obtained. As a result, an X-ray image intensifier which has a good luminance distribution and a high resolution can be obtained.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method of manufacturing an X-ray image intensifier, comprising:

preparing a spherical X-ray incident aluminum material window having a dome portion and a peripheral portion continuous to said dome portion, and a brazing sheet, which has an annular shape corresponding with that of a high-strength support frame that supports said X-ray incident window and said peripheral portion of said incident window, and which has a brazing layer at least on a region thereof which is to be brought into contact with said peripheral portion of said incident window and said support frame;

providing means for preventing a molten brazing material from reaching a region where an input screen is to be formed;

forming a groove in said prepared brazing sheet;

placing said brazing sheet on said support frame, and placing said peripheral portion of said incident window on said brazing sheet;

heating said brazing sheet, thus melting said brazing material, thereby hermetically brazing said incident window to said support frame through said brazing sheet;

forming an input screen for converting an X-ray image into a photoelectron image on an inner surface of said X-ray incident window;

hermetically sealing said X-ray incident window to a vessel, thus forming a vacuum envelope; and evacuating an interior of said vacuum envelope.

2. A method of manufacturing an X-ray image intensifier, comprising:

preparing a spherical X-ray incident aluminum material window having a dome portion and a peripheral portion continuous to said dome portion, and a brazing sheet, which has an annular shape corresponding with that of a high-strength support frame that supports said X-ray incident window and to said peripheral portion of said incident window, and which has a brazing layer at least on a region thereof which is to be brought into contact with said peripheral portion of said incident window and said support frame;

providing means for preventing a molten brazing material from reaching a region where an input screen is to be formed;

forming a bent portion to said prepared brazing sheet;

placing said brazing sheet on said support frame, and placing said peripheral portion of said incident window on said brazing sheet;

heating said brazing sheet, thus melting said brazing material, thereby hermetically brazing said incident window to said support frame through said brazing sheet;

forming an input screen for converting an X-ray image into a photoelectron image on an inner surface of said X-ray incident window;

hermetically sealing said X-ray incident window to a vessel, thus forming a vacuum envelope; and evacuating an interior of said vacuum envelope.

3. A method according to claim 1, wherein providing includes providing an anti-wetting layer made of a material which is hard to be wetted with said molten brazing material to said dome portion of said incident window.

4. A method according to claim 2, wherein after said brazing material layer is melted, an end portion of said bent portion is brought into contact with said dome portion of said incident window, so that said incident window is held by said bent portion.

* * * * *